US011484169B2

(12) United States Patent
Howard et al.

(10) Patent No.: US 11,484,169 B2
(45) Date of Patent: Nov. 1, 2022

(54) SURFACE TYPE DETECTION AND SURFACE TREATMENT APPARATUS USING THE SAME

(71) Applicant: SharkNinja Operating, LLC, Needham, MA (US)

(72) Inventors: Damian Howard, Winchester, MA (US); John White, Brookline, MA (US)

(73) Assignee: SharkNinja Operating LLC, Needham, MA (US)

( * ) Notice: Subject to any disclaimer, the term of this patent is extended or adjusted under 35 U.S.C. 154(b) by 222 days.

(21) Appl. No.: 16/843,153

(22) Filed: Apr. 8, 2020

(65) Prior Publication Data

US 2020/0315418 A1 Oct. 8, 2020

Related U.S. Application Data

(60) Provisional application No. 62/830,782, filed on Apr. 8, 2019.

(51) Int. Cl.
*A47L 9/28* (2006.01)
*A47L 5/30* (2006.01)
(Continued)

(52) U.S. Cl.
CPC ..... *A47L 9/2831* (2013.01); *A47L 5/30* (2013.01); *A47L 9/0411* (2013.01);
(Continued)

(58) Field of Classification Search
CPC ..... A47L 9/2831; A47L 5/30; A47L 9/0411; A47L 9/0477; A47L 9/0494;
(Continued)

(56) References Cited

U.S. PATENT DOCUMENTS 5,276,939 A * 1/1994 Uenishi ..... A47L 9/2857 15/319
5,881,430 A 3/1999 Driessen et al.
(Continued)

FOREIGN PATENT DOCUMENTS

CN 107920705 4/2018

OTHER PUBLICATIONS

PCT Search Report and Written Opinion dated Jun. 24, 2020, received in PCT Application No. PCT/US20/27196, 13 pgs.
(Continued)

*Primary Examiner* — David Redding
(74) *Attorney, Agent, or Firm* — Grossman Tucker Perreault & Pfleger, PLLC

(57) ABSTRACT

A surface treatment apparatus may include a surface cleaning head having an agitator, an agitator motor configured to cause the agitator to rotate, and a controller. The controller can be configured to determine a surface type corresponding to a surface to be cleaned and to transition the surface treatment apparatus between a first operational mode and a second operational mode based, at least in part, on the determined surface type. Determining the surface type may include measuring a plurality values corresponding to a current draw of the agitator motor over a predetermined time window at a predetermined time interval, determining an average corresponding to the measured values, comparing the average to at least a first threshold, and transitioning the surface treatment apparatus between the operational modes based, at least in part, on the comparison.

12 Claims, 6 Drawing Sheets

(51) Int. Cl.
*A47L 9/04* (2006.01)
*A47L 9/14* (2006.01)

(52) U.S. Cl.
CPC ..... *A47L 9/0477* (2013.01); *A47L 9/0494* (2013.01); *A47L 9/1409* (2013.01); *A47L 9/2826* (2013.01); *A47L 9/2842* (2013.01); *A47L 9/2847* (2013.01)

(58) Field of Classification Search
CPC .... A47L 9/1409; A47L 9/2826; A47L 9/2842; A47L 9/2847
See application file for complete search history.

(56) References Cited

U.S. PATENT DOCUMENTS

| | | | | |
|---|---|---|---|---|
| 2005/0065662 | A1* | 3/2005 | Reindle | A47L 9/2889 701/1 |
| 2006/0085095 | A1 | 4/2006 | Reindle et al. | |
| 2014/0366306 | A1* | 12/2014 | Clothier | A47L 9/2894 15/377 |
| 2016/0213218 | A1 | 7/2016 | Ham et al. | |
| 2017/0000305 | A1* | 1/2017 | Gordon | A47L 9/0477 |
| 2019/0021567 | A1 | 1/2019 | Zhou | |

OTHER PUBLICATIONS

Chinese Office Action with English translation dated Apr. 29, 2022, received in Chinese Patent Application No. 202080027349.8, 17 pages.

* cited by examiner

SURFACE TYPE DETECTION AND SURFACE TREATMENT APPARATUS USING THE SAME

CROSS-REFERENCE TO RELATED APPLICATIONS

The present application claims the benefit of U.S. Provisional Application Ser. No. 62/830,782 filed on Apr. 8, 2019, entitled Surface Type Detection and Surface Treatment Apparatus using the same, which is fully incorporated herein by reference.

TECHNICAL FIELD

The present disclosure is generally related to surface type detection and more specifically related to a vacuum cleaner configured to determine a surface type for a surface on which it travels.

BACKGROUND INFORMATION

Surface treatment apparatuses can include upright vacuum cleaners configured to be transitionable between a storage position and an in-use position. Upright vacuum cleaners can include a suction motor configured to draw air into an air inlet of the upright vacuum cleaner such that debris deposited on a surface can be urged into the air inlet. At least a portion of the debris urged into the air inlet can be deposited within a dust cup of the upright vacuum cleaner for later disposal.

BRIEF DESCRIPTION OF THE DRAWINGS

These and other features and advantages will be better understood by reading the following detailed description, taken together with the drawings, wherein.

DETAILED DESCRIPTION

The present disclosure is generally related to a surface treatment apparatus configured to detect a surface type. An example of the surface treatment apparatus may be a vacuum cleaner having an agitator configured to agitate/dislodge debris adhered to a surface to be cleaned (e.g., a floor) from the surface to be cleaned, an agitator motor configured to rotate the agitator, a dust cup configured to collect debris from the surface to be cleaned, and a suction motor configured to draw debris into the dust cup. A current draw (or any other motor parameter such as a voltage draw) of the agitator motor can be measured such that a surface type (e.g., carpeted or hard floor) can be determined based, at least in part, on a measured current of the agitator motor. An operational mode of the vacuum cleaner can be based, at least in part, on the determined surface type. For example, a rotation speed of the agitator or a suction force of the suction motor may be based, at least in part, on the determined surface type.

One example of surface type detection based, at least in part, on a current draw of the agitator motor can include taking two or more measurements of the current draw over a predetermined time window and averaging the measurements to obtain an average current value. The average current value can be compared to one or more threshold values such that based, at least in part, on the comparison the surface type can be determined. For example, the average current value can be compared to a first threshold when the vacuum cleaner is operating in a first operational mode (e.g., a hard surface mode) and the average current can be compared to a second threshold when the vacuum cleaner is operating in a second operational mode (e.g., a carpet mode).

Figure 1A:
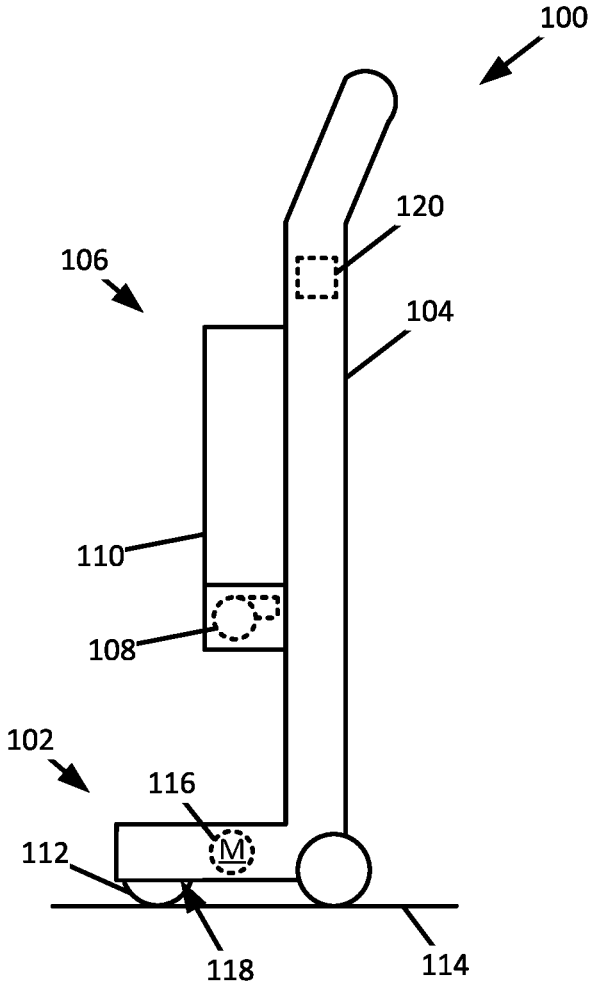
FIG. 1A is a schematic example of a vacuum cleaner, consistent with embodiments of the present disclosure.

FIG. 1A shows a schematic example of a vacuum cleaner 100. As shown, the vacuum cleaner 100 includes a surface cleaning head 102, an upright section 104 pivotally coupled to the surface cleaning head 102, and a vacuum assembly 106 coupled to the upright section 104. The vacuum assembly 106 can include a suction motor 108 (shown in hidden lines) and a dust cup 110, each being fluidly coupled to the surface cleaning head 102, wherein the suction motor 108 is configured to cause air to be suctioned into the surface cleaning head 102. The surface cleaning head 102 can include one or more agitators 112 (e.g., a brush roll) configured to engage a surface to be cleaned 114 (e.g., a floor).

The one or more agitators 112 can be coupled to an agitator motor 116 (shown in hidden lines) such that energization of the agitator motor 116 causes the one or more agitators 112 to rotate. Rotation of the one or more agitators 112 can agitate/dislodge debris adhered to the surface to be cleaned 114 from the surface to be cleaned 114. Once agitated/dislodged the suction motor 108 can draw the debris into an air inlet 118 of the surface cleaning head 102 such that the debris can be deposited in the dust cup 110.

Current draw of the agitator motor 116 can vary in response to a surface type of the surface to be cleaned 114. Changes in an amount of engagement between the one or more agitators 112 and the surface to be cleaned 114 can cause the current draw of the agitator motor 116 to vary. For example, a carpeted surface type may have increased engagement with the one or more agitators 112 causing increased current draw when compared to a hard surface type. As such, the surface type can be determined based, at least in part, on the changes in current draw.

A measure of current draw within a predetermined time window can be averaged to obtain an average current value that corresponds to a respective time window. For example, the current draw may be measured two or more times at a predetermined time interval within a predetermined time window and averaged to obtain an average current value. The average current value can be compared to one or more thresholds and a floor type can be determined based, at least in part, on the comparison. By way of further example, the current draw may be measured two or more times at a predetermined time interval for two or more time windows and an average current value for each time window may be determined. The average current values for each time window may be compared to one or more thresholds to determine a floor type. For example, when one or more (e.g., all) of the average current values corresponding to each of the time windows measures less than (or greater than) a threshold, a change in floor type may be determined. In some instances, the measured current values may not be averaged and, instead, the measured current values may each be compared to at least one threshold.

In response to determining a change in floor type, the vacuum cleaner 100 can be caused to transition between two or more operational modes. As such, a transition between operational modes may be based, at least in part, on the average current value for the current draw of the agitator motor 116 corresponding to a predetermined time window. Use of average current may reduce the occurrence of erroneous mode changes caused by fluctuations in current draw resulting from, for example, forward and backward movement of the vacuum cleaner 100 across the surface to be cleaned 114.

A first operational mode may correspond to hard surfaces and a second operational mode may correspond to carpeted surfaces. Upon startup of the vacuum cleaner 100, the vacuum cleaner 100 may default to one of the operational modes (e.g., a carpet operational mode or hard surface operational mode) and then change operational modes if the floor type is determined to be inconsistent with the current operational mode. In some instances, upon startup, the vacuum cleaner 100 may resume the operational mode that was being executed when the vacuum cleaner 100 was last turned off.

In some instances, the average current value of the current draw of the agitator motor 116 can be compared to one of two or more thresholds, wherein each threshold corresponds to a respective operational mode. For example, when the vacuum cleaner 100 is in the first operational mode, the average current value can be compared to a first threshold in order to determine whether to transition from the first operational mode to the second operational mode (e.g., the comparison may include determining whether the average current value measures greater than the first threshold). By way of further example, when the vacuum cleaner 100 is in the second operational mode, the average current value can be compared to a second threshold in order to determine whether to transition from the second operational mode to the first operational mode (e.g., the comparison may include determining whether the average current value measures less than the second threshold). In some instances, the average current value can be compared to a single threshold regardless of the operational mode of the vacuum cleaner 100.

After the vacuum cleaner 100 has transitioned between modes, a mode timeout may be instituted. The mode timeout may prevent the vacuum cleaner 100 from transitioning between modes for a predetermined period of time. During the mode timeout, the current draw may not be measured and/or averaged. The mode timeout can be configured to allow the vacuum cleaner 100 to fully transition to the first or second operational mode (e.g., the suction motor 108 and/or the agitator motor 116 reach a desired operational speed).

In some instances, a first mode timeout may correspond to when the vacuum cleaner 100 transitions from the first operational mode to the second operational mode and a second mode timeout may correspond to when the vacuum cleaner 100 transitions from the second operational mode to the first operational mode. The first and second mode timeouts may correspond to different predetermined time periods.

Figure 1B:
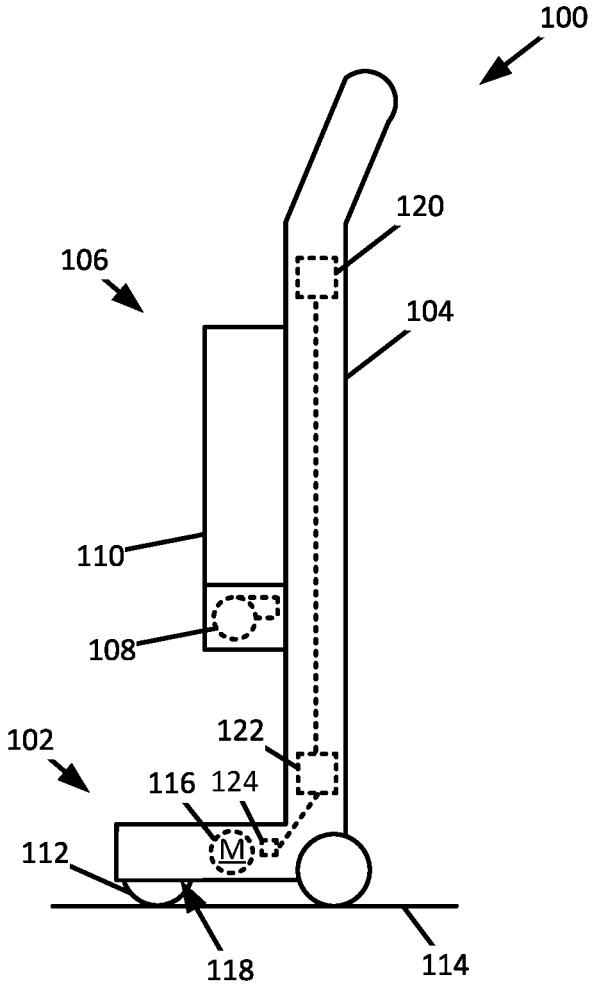
FIG. 1B is another schematic example of a vacuum cleaner, consistent with embodiments of the present disclosure.

The vacuum cleaner 100 can include a controller 120 (shown in hidden lines) configured to transition the vacuum cleaner 100 between operational modes (e.g., between at least a first and a second operational mode). For example, the controller 120 can be configured to measure the current draw of the agitator motor 116, average the current draw, compare the average current value to a threshold, and/or cause the vacuum cleaner 100 to transition between operational modes. The controller 120 can also be configured to receive instructions from a user of the vacuum cleaner 100 via one or more user inputs (e.g., toggles, touch screens, and/or any other user input). Additionally, or alternatively, the vacuum cleaner 100 can include circuitry (e.g., an application specific integrated circuit) configured to, for example, measure the current draw of the agitator motor 116, average the current draw, compare the average current value to a threshold, and/or cause the vacuum cleaner 100 to transition between operational modes. In some instances, for example as shown in FIG. 1B, circuitry 122 may be communicatively coupled to the controller 120. The circuitry 122 can be configured to measure the current draw (e.g., using a current sensor 124 electrically coupled to the agitator motor 116), compare the measured current to a threshold (e.g., using a comparator), and/or the like. In these instances, the controller 120 can be configured to, for example, cause the vacuum cleaner 100 to transition between operational modes based upon one or more outputs received from the circuitry 122. In some instances, the circuitry 122 can include one or more of a window comparator, a metal-oxide semiconductor field-effect transistor (MOSFET) logic gate, and/or any other circuit components.

Figure 1C:
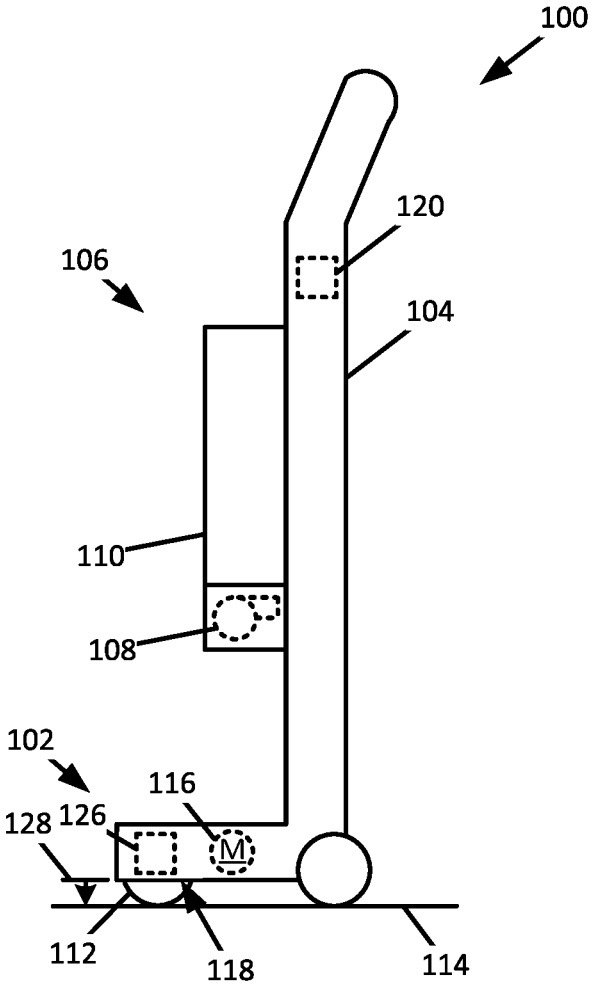
FIG. 1C is another schematic example of a vacuum cleaner, consistent with embodiments of the present disclosure.

In some instances, and as shown, for example, in FIG. 1C, the vacuum cleaner 100 may include an agitator height adjuster 126 (shown in hidden lines). The agitator height adjuster 126 may adjust an engagement distance 128 between the agitator 112 and the surface to be cleaned 114. For example, the agitator height adjuster 126 may include one or more levers configured to change the engagement distance 128 in response to the user exerting a force on the lever. By way of further example, the agitator height adjuster 126 may include one or more motors configured to change the engagement distance 128.

The engagement distance 128 may generally be described as a separation distance extending from an axis of rotation of the agitator 112 to a lower most surface of the surface to be cleaned 114 that faces the agitator 112. For example, when the surface to be cleaned is a carpet, the surface to be cleaned 114 includes a substrate and fibrous material extending from the substrate. Therefore, the engagement distance 128, as measured relative to carpet, would correspond to a separation distance measured from the axis of rotation of the agitator 112 to a surface of the substrate from which the fibrous material extends. As the engagement distance 128 decreases an amount of engagement between the surface to be cleaned 114 and the agitator 112 increases. Similarly, as the engagement distance 128 increases the amount of engagement between the surface to be cleaned 114 and the agitator decreases.

Changing the engagement distance 128 changes an amount of engagement between the agitator 112 and the surface to be cleaned 114. As such, the current draw of the agitator motor 116 will change when changing the engagement distance 128. For example, the current draw of the agitator motor 116 will increase as the engagement distance 128 decreases and decrease as the engagement distance 128 increases.

Therefore, in some instances, the thresholds for determining floor types may be adjusted based, at least in part, on a measure of the engagement distance 128. For example, when agitator height adjuster 126 includes a manually adjustable lever one or more microswitches, potentiometers, and/or any other component may be used to measure a position of the lever and/or the agitator 112. Based, at least in part, on the position of the lever, for example, the engagement distance 128 can be determined. By way of further example, when the agitator height adjuster 126 includes a motor, a measure of the engagement distance 128 can be determined based, at least in part, on a number of rotations of a drive shaft of the motor (e.g., based, at least in part, on a known prior location stored in the controller 120 and the number of rotations of the drive shaft the engagement distance 128 can be determined).

In instances where the agitator height adjuster 126 includes a motor, the engagement distance 128 may be automatically adjusted based, at least in part, on a detected floor type (e.g., in response to a command issued by the controller 120). In some instances, a mode change may include changing the engagement distance 128. For example, when the floor type is determined to be carpet, the engagement distance 128 may be decreased such that the amount of engagement between the agitator 112 and the surface to be cleaned 114 is increased. In these instances, based, at least in part, on changes in current draw caused by the change in the engagement distance 128, a carpet type may be determined (e.g., high pile, medium pile, and/or low pile carpet). In some instances, when the vacuum cleaner 100 is operating in an operational mode (e.g., a carpet mode), there may be secondary current draw thresholds that are associated with the operational mode, wherein the agitator height adjuster 126 changes the engagement distance 128 based, at least in part, on the secondary thresholds associated with the operational mode. For example, a first secondary threshold may correspond to a high pile carpet and another secondary threshold may correspond to a low pile carpet and the height adjuster 126 may change the engagement distance 128 based, at least in part, on the current draw crossing the high and/or low pile secondary thresholds.

Figure 2:
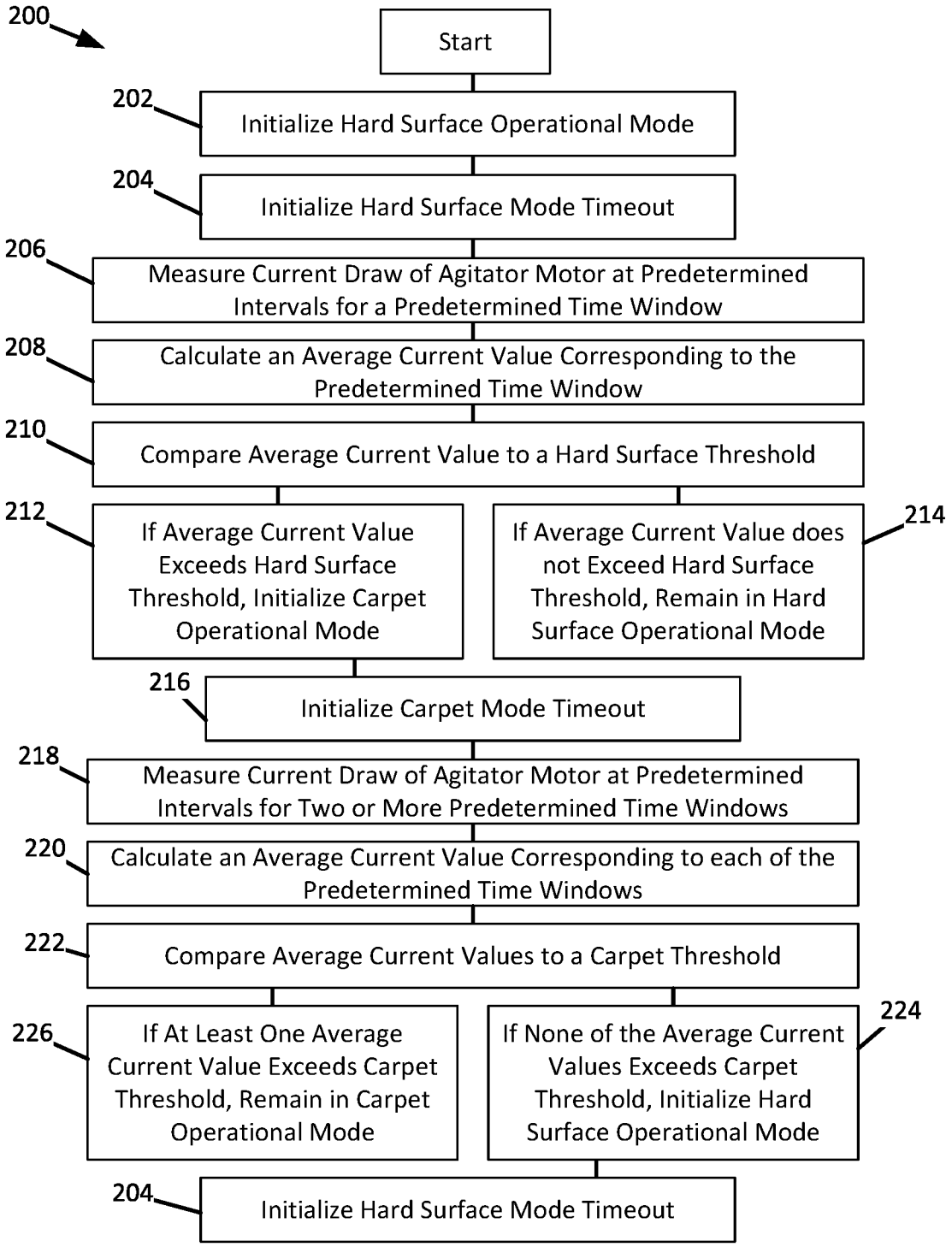
FIG. 2 is a flow chart illustrating an example of a method for determining a surface type of a surface to be cleaned, consistent with embodiments of the present disclosure.

FIG. 2 shows a flow chart illustrating an example of a method 200 for determining a surface type of a surface to be cleaned. The method 200 may be embodied in any one or more of software, firmware, and/or hardware. For example, the method 200 may be embodied as software configured to execute on the controller 120 of FIG. 1A.

As shown, the method 200 commences when, for example, the vacuum cleaner 100 is powered on. The method 200 may include a step 202. The step 202 includes causing the vacuum cleaner 100 to initialize a predetermined operational mode. For example, and as shown, the predetermined operational mode may be a hard surface operational mode.

The method 200 may also include a step 204. The step 204 includes initializing a hard surface mode timeout. The hard surface mode timeout prevents the vacuum cleaner 100 from transitioning from the hard surface operational mode to the carpet operational mode for a predetermined period of time. The hard surface mode timeout may generally correspond to the time required for the agitator motor 116 and/or the suction motor 108 to transition to the desired rotational speeds. For example, the predetermined period of time corresponding to the hard surface mode timeout may measure in a range of 0.5 seconds to 2 seconds. By way of further example, the predetermined period of time corresponding to the hard surface mode timeout may measure in a range of 1 second to 1.4 seconds.

The method 200 may also include a step 206. The step 206 includes measuring a current draw of the agitator motor 116 at predetermined hard surface time intervals within a predetermined hard surface time window. For example, the predetermined hard surface time interval may measure in a range of 10 milliseconds to 100 milliseconds and the predetermined hard surface time window may measure in a range of 100 milliseconds to 500 milliseconds. By way of further example, the current draw may be sampled at 40 millisecond intervals within a 200 millisecond hard surface time window for a total of five current draw samples per hard surface time window.

The method 200 may also include a step 208. The step 208 includes calculating an average current value corresponding to the current draw samples measured in the predetermined hard surface time window upon expiration of the predetermined hard surface time window. For example, when the predetermined hard surface time window is 200 milliseconds, the average current value is calculated every 200 milliseconds.

The method 200 may also include a step 210. The step 210 includes comparing the calculated average current value to a hard surface to carpet threshold (which may generally be referred to as a hard surface threshold) to determine whether the average current value exceeds the hard surface threshold. The hard surface threshold may measure, for example, in a range of 0.5 amp to 4 amps. By way of further example, the hard surface threshold may measure 2 amps.

The method may also include a step 212 and/or a step 214. The step 212 includes initializing a carpet operational mode when the calculated average current value exceeds the hard surface threshold. Initializing the carpet operational mode may cause one or more of the agitator motor 116 to increase the rotational speed of the agitator 112 and/or cause the suction motor 108 to increase or decrease suction generated at the air inlet 118. In some instances, initializing the carpet operational mode may cause an indicator to indicate the changing of operational modes (e.g., a light source may illuminate for a predetermined period of time). The step 214 includes remaining in the hard surface operational mode when the average current value does not exceed the hard surface threshold. The step 214 may also include causing steps 206, 208, and 210 to be repeated until the calculated average current value exceeds the hard surface threshold.

The method may also include a step 216. The step 216 may include initializing a carpet mode timeout when the calculated average current exceeds the hard surface threshold and the carpet operational mode is initialized. The carpet mode timeout prevents the vacuum cleaner 100 from transitioning from the carpet operational mode to the hard surface operational mode for a predetermined period of time. The carpet mode timeout may generally correspond to the time required for the agitator motor 116 and/or the suction motor 108 to transition to the desired rotational speeds. For example, the predetermined period of time corresponding to the carpet mode timeout may measure in a range of 0.5 seconds to 2 seconds. By way of further example, the predetermined period of time corresponding to the carpet mode timeout may measure in a range of 500 milliseconds to 1 second.

The method 200 may also include a step 218. The step 218 includes measuring a current draw of the agitator motor 116 at predetermined carpet time intervals within a predetermined carpet time window. For example, the predetermined carpet time interval may measure in a range of 10 milliseconds to 100 milliseconds and the predetermined carpet time window may measure in a range of 100 milliseconds to 500 milliseconds. By way of further example, the current draw may be sampled at 40 millisecond intervals within a 200 millisecond carpet time window for a total of five current draw samples per carpet time window.

The method 200 may also include a step 220. The step 220 includes calculating an average current value corresponding to the current draw samples measured in the predetermined carpet time window. For example, when the predetermined carpet time window is 200 milliseconds, the average current value is calculated every 200 milliseconds. In some instances, two or more carpet time windows may be sampled, forming a window group. The average current value may be calculated for each carpet time window in a respective window group. For example, five 200 millisecond carpet time windows may be sampled at 40 millisecond intervals and each of the samples within each of the five carpet time windows may be averaged to obtain five average current values. The averages for each carpet time window within a respective window group may be calculated after each time window within the window group is completely sampled. For example, for a window group having five 200 millisecond carpet time windows the average current value corresponding to each carpet time window may only be calculated every second. As such, each window group includes five unique averages. In other instances, each carpet time window may be averaged upon completion of the last sample corresponding to the carpet time window. In this example, the window group may correspond to a predetermined number of the most recent carpet windows. As such, each window group includes one unique average and one or more previously calculated averages.

The method 200 may also include a step 222. The step 222 includes comparing each calculated average current value to a carpet to hard surface threshold (which may generally be referred to as a carpet threshold) to determine whether each average current value exceeds the carpet threshold. The carpet threshold may measure, for example, in a range of 0.5 amp to 4 amps. By way of further example, the carpet threshold may measure 2.64 amps.

The method may also include a step 224 and/or a step 226. The step 224 includes initializing the hard surface operational mode when each calculated average current value does not exceed (i.e., falls below) the carpet threshold. Initializing the hard surface operational mode may cause one or more of the agitator motor 116 to decrease the rotational speed of the agitator 112 and/or cause the suction motor 108 to increase or decrease suction generated at the air inlet 118. In some instances, initializing the hard surface operational mode may cause an indicator to indicate the changing of operational modes (e.g., a light source may illuminate for a predetermined period of time). The step 226 includes remaining in the carpet operational mode when at least one average current value exceeds the carpet threshold (e.g., a maximum average current value). The step 226 may also cause steps 218, 220, and 222 to be repeated until each calculated average current value does not exceed the carpet threshold.

If the vacuum cleaner 100 transitions from the carpet operational mode to the hard surface operational mode in step 224, the hard surface mode timeout can be initiated as described in the step 204 and steps 206, 208, 210, and 214 can be carried out until the conditions of step 212 are met.

Figure 3:
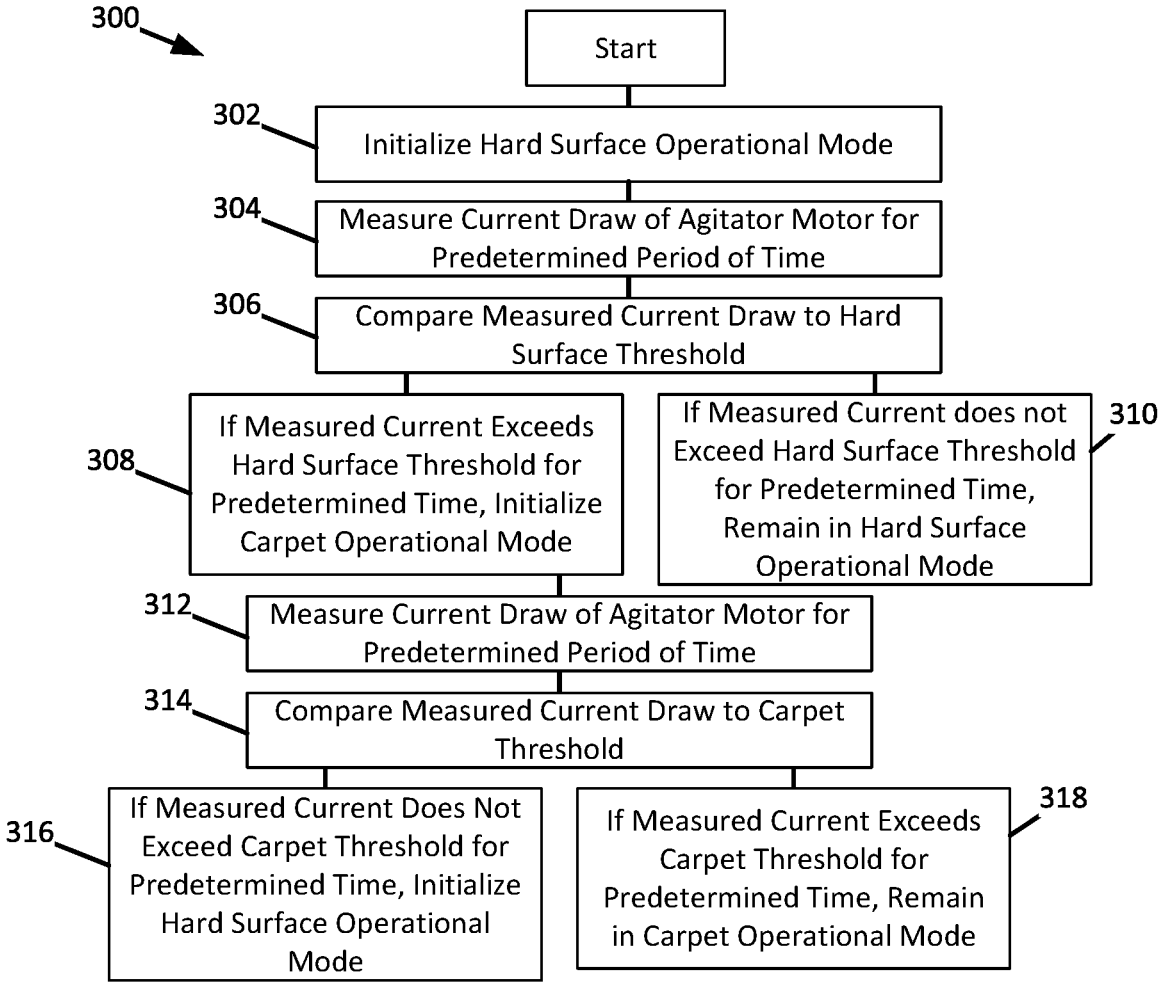
FIG. 3 is a flow chart illustrating an example of another method for determining a surface type of a surface to be cleaned, consistent with embodiments of the present disclosure.

FIG. 3 shows a flow chart illustrating an example of a method 300 for determining a surface type of a surface to be cleaned. The method 300 may be embodied in any one or more of software, firmware, and/or hardware. For example, the method 300 may be embodied as software configured to execute on the controller 120 of FIG. 1A.

As shown, the method 300 commences when, for example, the vacuum cleaner 100 is powered on. The method 300 may include a step 302. The step 302 includes causing the vacuum cleaner 100 to initialize a predetermined operational mode. For example, and as shown, the operational mode may be a hard surface operational mode.

The method 300 may also include a step 304. The step 304 includes measuring a current draw of the agitator motor 116 for a time window. The time window over which the current draw of the agitator motor 116 is measured may measure in a range of 100 milliseconds to 1 second.

The method 300 may also include a step 306. The step 306 includes comparing the measured current to a hard surface to carpet threshold (which may generally be referred to as a hard surface threshold). The hard surface threshold may measure in a range of 0.5 amp to 4 amps.

The method 300 may also include a step 308 and/or a step 310. The step 308 includes initializing a carpet operational mode if the measured current is determined to have not fallen below the hard surface threshold during the time window during which the current draw was measured. Transitioning to the carpet operational mode may cause one or more of the agitator motor 116 to increase the rotational speed of the agitator 112 and/or cause the suction motor 108 to increase or decrease suction generated at the air inlet 118. In some instances, initializing the carpet operational mode may cause an indicator to indicate the changing of operational modes (e.g., a light source may illuminate for a predetermined period of time). The step 310 includes remaining in the hard surface operational mode if the measured current is determined to not have exceeded the hard surface threshold during the time window during which the current draw was measured. If the measured current exceeds the hard surface threshold for a portion of the time window, the vacuum cleaner 100 may remain in the hard surface operational mode. Alternatively, in some instances, if the measured current exceeds the hard surface threshold for a portion of the time window, the vacuum cleaner 100 may transition to the carpet operational mode.

The method 300 may also include a step 312. The step 312 includes measuring current draw of the agitator motor 116 for a time window when the measured current is determined to exceed the hard surface threshold. The time window over which the current draw of the agitator motor 116 is measured may measure in a range of 100 milliseconds to 1 second.

The method 300 may also include a step 314. The step 314 includes comparing the measured current draw to a carpet to hard surface threshold (which may generally be referred to as a carpet threshold). The carpet threshold may measure in a range of 0.5 amp to 4 amps.

The method 300 may also include a step 316 and/or a step 318. The step 316 includes initializing the hard surface operational mode if the measured current is determined to have not exceeded the carpet threshold during the time window during which the current draw was measured. Transitioning to the hard surface operational mode may cause one or more of the agitator motor 116 to decrease the rotational speed of the agitator 112 and/or cause the suction motor 108 to increase or decrease suction generated at the air inlet 118. In some instances, initializing the hard surface operational mode may cause an indicator to indicate the changing of operational modes (e.g., a light source may illuminate for a predetermined period of time). The step 318 includes remaining in the carpet operational mode if the measured current is determined to have not fallen below the carpet threshold during the time window during which the current draw was measured. If the measured current falls below the carpet threshold for a portion of the time window, the vacuum cleaner 100 may remain in the carpet operational mode. Alternatively, in some instances, if the measured current falls below the carpet threshold for a portion of the time window, the vacuum cleaner 100 may transition to the hard surface operational mode.

If the vacuum cleaner 100 transitions from the carpet operational mode to the hard surface operational mode in step 316, steps 304, 306, and 310 can be carried out until the conditions of step 308 are met. Between mode changes there may be a timeout period. During the timeout period additional mode changes may be prevented. The timeout period may generally correspond to the time required for the agitator motor 116 and/or the suction motor 108 to transition to the desired rotational speeds. For example, the timeout period may measure between 500 milliseconds and 5 seconds.

Figure 4:
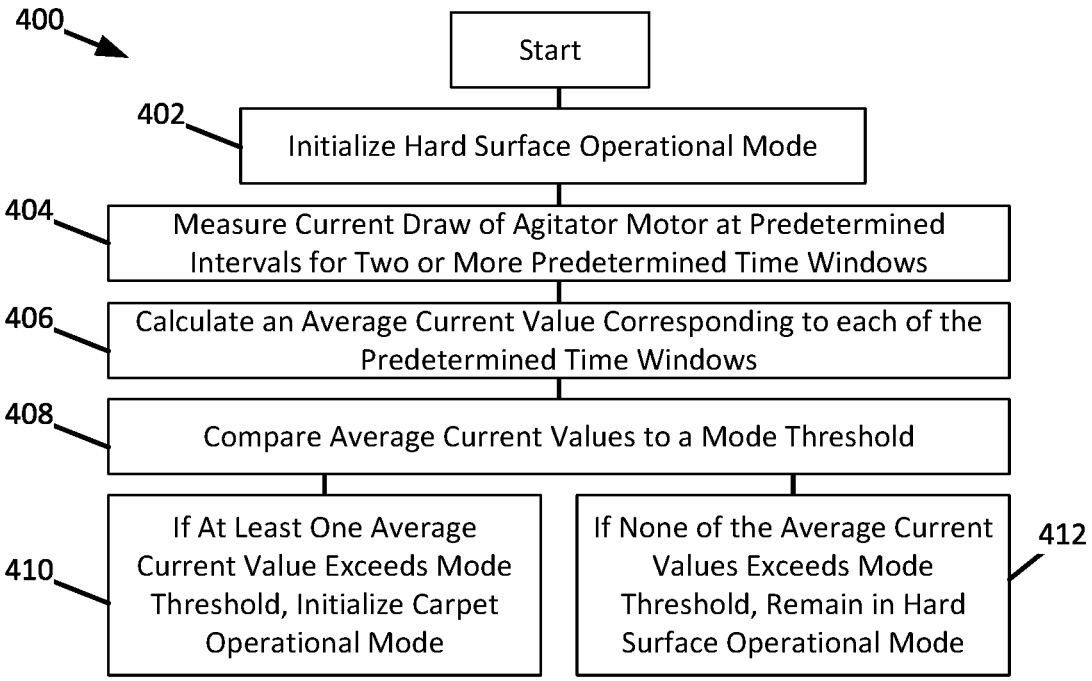
FIG. 4 is a flow chart illustrating an example of another method for determining a surface type of a surface to be cleaned, consistent with embodiments of the present disclosure.

FIG. 4 shows a flow chart illustrating an example of a method 400 for determining a surface type of a surface to be cleaned. The method 400 may be embodied in any one or more of software, firmware, and/or hardware. For example, the method 400 may be embodied as software configured to execute on the controller 120 of FIG. 1A.

As shown, the method 400 commences when, for example, the vacuum cleaner 100 is powered on. The method 400 may include a step 402. The step 402 includes causing the vacuum cleaner 100 to initialize a predetermined operational mode. For example, and as shown, the predetermined operational mode may be a hard surface operational mode.

The method 400 may also include a step 404. The step 404 includes measuring a current draw of the agitator motor 116 at predetermined time intervals within a predetermined time window. For example, the predetermined time interval may measure in a range of 10 milliseconds to 100 milliseconds and the predetermined time window may measure in a range of 100 milliseconds to 500 milliseconds. By way of further example, the current draw may be sampled at 40 millisecond intervals within a 200 millisecond time window for a total of five current draw samples.

The method 400 may also include a step 406. The step 406 includes calculating an average current value corresponding to the current draw samples measured in the predetermined time window. For example, when the predetermined time window is 200 milliseconds, the average current value is calculated every 200 milliseconds. In some instances, two or more time windows may be sampled, forming a window group. The average current value may be calculated for each time window in a respective window group. For example, five 200 millisecond time windows may be sampled at 40 millisecond intervals and each of the samples within each of the five carpet time windows may be averaged to obtain five average current values. The averages for each time window within a respective window group may be calculated after each time window within the window group is completely sampled. For example, for a window group having five 200 millisecond time windows the average current value corresponding to each time window may only be calculated every second. As such, each window group includes five unique averages. In other instances, each time window may be averaged upon completion of the last sample corresponding to the time window. In this example, the window group may correspond to a predetermined number of the most recent time windows. As such, each window group includes one unique average and one or more previously calculated averages.

The method 400 may also include a step 408. The step 408 includes comparing each calculated average current value to a mode threshold to determine whether at least one average current value (e.g., the max current value) exceeds the mode threshold. The mode threshold may measure, for example, in a range of 0.5 amp to 4 amps.

The method 400 may also include a step 410 and/or a step 412. The step 410 includes initializing the carpet operational mode if at least one average current value is determined to exceed the mode threshold. The step 410 may also include causing steps 404, 406, and 408 to be repeated until none of the average current values exceed the mode threshold. In this instance, the vacuum cleaner 100 may be caused to transition into the hard surface operational mode. The step 412 includes remaining in the hard surface operational mode if none of the average current values exceed the mode threshold. The step 412 may also include causing steps 404, 406, and 408 to be repeated until at least one of the average current values exceed the mode threshold. In this instance, the vacuum cleaner 100 can be caused to transition into the carpet operational mode.

Between mode changes there may timeout period. During the timeout period additional mode changes may be prevented. The timeout period may generally correspond to the time required for the agitator motor 116 and/or the suction motor 108 to transition to the desired rotational speeds. For example, the timeout period may measure between 500 milliseconds and 5 seconds.

The present disclosure has generally discussed determining surface type by measuring current draw. However, other motor parameters (e.g., voltage draw) may additionally, or alternatively, be used to determine floor type in a manner consistent with the present disclosure. For example, voltage may be measured, averaged, and compared to a threshold in a manner similar to those described herein.

An example of a surface treatment apparatus, consistent with the present disclosure, may include a surface cleaning head having an agitator, an agitator motor configured to cause the agitator to rotate, and a controller configured to determine a surface type corresponding to a surface to be cleaned and to transition the surface treatment apparatus between a first operational mode and a second operational mode based, at least in part, on the determined surface type. Determining the surface type may include measuring a plurality values corresponding to a current draw of the agitator motor over a predetermined time window at a predetermined time interval, determining an average corresponding to the measured values, comparing the average to at least a first threshold, and transitioning the surface treatment apparatus between the operational modes based, at least in part, on the comparison.

In some instances, the average may be compared to a respective one of the first threshold or a second threshold, the average being compared to the first threshold when the surface treatment apparatus is operating in the first operational mode and the average being compared to the second threshold when the surface treatment apparatus is operating in the second operational mode, the first threshold being different from the second threshold. In some instances, when the surface treatment apparatus is in the first operational mode, if the average measures greater than the first threshold the surface treatment apparatus may transition to the second operational mode. In some instances, when the surface treatment apparatus is in the second operational mode, if the average measures less than the second threshold the surface treatment apparatus may transition to the first operational mode. In some instances, measuring may further include measuring over a plurality of time windows, wherein the plurality of values corresponding to the current draw are measured for each predetermined time window at the predetermined time interval. In some instances, determining the average may include determining a plurality of average values, each of the plurality of average values corresponding to a respective time window. In some instances, when all of the average values measures less than the second threshold and the surface treatment apparatus is in the second operational mode, the surface treatment apparatus may transition to the first operational mode.

An example of a vacuum cleaner, consistent with the present disclosure, may include a surface cleaning head having an agitator, a dust cup fluidly coupled to the surface cleaning head, a suction motor fluidly coupled to the surface cleaning head and configured to generate suction at an inlet of the surface cleaning head, an agitator motor configured to cause the agitator to rotate, and a controller configured to determine a surface type corresponding to a surface to be cleaned and to transition the vacuum cleaner between a first operational mode and a second operational mode based, at least in part, on the determined surface type. Determining the surface type may include measuring a plurality values corresponding to a current draw of the agitator motor over a predetermined time window at a predetermined time interval, determining an average corresponding to the measured values, comparing the average to at least a first threshold, and transitioning the vacuum cleaner between the operational modes based, at least in part, on the comparison.

In some instances, the average may be compared to a respective one of the first threshold or a second threshold, the average being compared to the first threshold when the vacuum cleaner is operating in the first operational mode and the average being compared to the second threshold when the vacuum cleaner is operating in the second operational mode, the first threshold being different from the second threshold. In some instances, when the vacuum cleaner is in the first operational mode, if the average measures greater than the first threshold the vacuum cleaner may transition to the second operational mode. In some instances, when the vacuum cleaner is in the second operational mode, if the average measures less than the second threshold the vacuum cleaner may transition to the first operational mode. In some instances, measuring may include measuring over a plurality of time windows, wherein the plurality of values corresponding to the current draw are measured for each predetermined time window at the predetermined time interval. In some instances, determining the average may include determining a plurality of average values, each of the plurality of average values corresponding to a respective time window. In some instances, when all of the average values measure less than the second threshold and the vacuum cleaner is in the second operational mode, the vacuum cleaner may transition to the first operational mode.

Another example of a surface treatment apparatus, consistent with the present disclosure, may include a surface cleaning head having an agitator, an agitator motor configured to cause the agitator to rotate, and a controller configured to determine a surface type corresponding to a surface to be cleaned and to transition the surface treatment apparatus between a first operational mode and a second operational mode based, at least in part, on the determined surface type. Determining the surface type may include measuring a plurality values corresponding to one or more parameters of the agitator motor over a predetermined time window at a predetermined time interval, determining an average corresponding to the measured values, comparing the average to at least a first threshold, and transitioning the surface treatment apparatus between the operational modes based, at least in part, on the comparison.

In some instances, the average may be compared to a respective one of the first threshold or a second threshold, the average being compared to the first threshold when the surface treatment apparatus is operating in the first operational mode and the average being compared to the second threshold when the surface treatment apparatus is operating in the second operational mode, the first threshold being different from the second threshold. In some instances, when the surface treatment apparatus is in the first operational mode, if the average measures greater than the first threshold the surface treatment apparatus may transition to the second operational mode. In some instances, when the surface treatment apparatus is in the second operational mode, if the average measures less than the second threshold the surface treatment apparatus may transition to the first operational mode. In some instances, measuring may include measuring over a plurality of time windows, wherein the plurality of values corresponding to the one or more parameters are measured for each predetermined time window at the predetermined time interval. In some instances, determining the average may include determining a plurality of average values, each of the plurality of average values corresponding to a respective time window. In some instances, when all of the average values measure less than the second threshold and the surface treatment apparatus is in the second operational mode, the surface treatment apparatus may transition to the first operational mode.

While the present disclosure has discussed a detecting a surface type of a surface to be cleaned using an upright vacuum cleaner, other surface treatment apparatuses may be used. For example, the surface cleaning apparatus may be a robotic cleaner, a handheld cleaner, a canister vacuum cleaner, and/or any other type of cleaner.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A surface treatment apparatus comprising:

a surface cleaning head having an agitator;

an agitator motor configured to cause the agitator to rotate; and a controller configured to determine a surface type corresponding to a surface to be cleaned and to transition the surface treatment apparatus between a first operational mode and a second operational mode based, at least in part, on the determined surface type, wherein determining the surface type includes:

initializing the first operational mode of the surface treatment apparatus;

measuring a first plurality of values corresponding to a current draw of the agitator motor over a first predetermined time window at a predetermined time interval;

measuring a second plurality of values corresponding to the current draw of the agitator motor over a second predetermined time window at the predetermined time interval;

determining a first average corresponding to the first plurality of measured values;

determining a second average corresponding to the second plurality of measured values;

comparing the first average and the second average to at least a first threshold;

initializing the second operational mode when at least one of the first average or the second average exceeds the first threshold; and remaining in the first operational mode when none of the first average and the second average exceeds the first threshold.

2. The surface treatment apparatus of claim 1, wherein, when the surface treatment apparatus is in the second operational mode, if both of a third average and the fourth average are less than a second threshold the surface treatment apparatus transitions to the first operational mode.

3. A vacuum cleaner comprising:

a surface cleaning head having an agitator;

a dust cup fluidly coupled to the surface cleaning head;

a suction motor fluidly coupled to the surface cleaning head;

an agitator motor configured to cause the agitator to rotate; and a controller configured to determine a surface type corresponding to a surface to be cleaned and to transition the vacuum cleaner between a first operational mode and a second operational mode based, at least in part, on the determined surface type, wherein determining the surface type includes:

initializing the first operational mode of the surface treatment apparatus;

measuring a first plurality of values corresponding to a current draw of the agitator motor over a first predetermined time window at a predetermined time interval;

measuring a second plurality of values corresponding to the current draw of the agitator motor over a second predetermined time window at the predetermined time interval;

determining a first average corresponding to the first plurality measured values;

determining a second average corresponding to the second plurality of measured values;

comparing the first average and the second average to at least a first threshold;

initializing the second operational mode when none of the first average and the second average exceeds the first threshold; and remaining in the first operational mode when at least one of the first average or the second average exceeds the first threshold.

4. The vacuum cleaner of claim 3, wherein, when the vacuum cleaner is in the second operational mode;

measuring a third plurality of values corresponding to the current draw of the agitator motor over a third predetermined time window at the predetermined time interval;

determining a third average corresponding to the third plurality of measured values;

comparing the third average to a second threshold;

if the third average is less than the second threshold the vacuum cleaner remains in the second operational mode; and if the third average is greater than the second threshold the vacuum cleaner transitions to the first operational mode.

5. A surface treatment apparatus comprising:

a surface cleaning head having an agitator;

an agitator motor configured to cause the agitator to rotate; and a controller configured to determine a surface type corresponding to a surface to be cleaned and to transition the surface treatment apparatus between a first operational mode and a second operational mode based, at least in part, on the determined surface type, wherein determining the surface type includes:

initializing the first operational mode of the surface treatment apparatus;

measuring a first plurality of values corresponding to one or more parameters of the agitator motor over a first predetermined time window at a predetermined time interval;

measuring a second plurality of values corresponding to one or more parameters of the agitator motor over a second predetermined time window at the predetermined time interval;

determining a first average corresponding to the first plurality of measured values;

determining a second average corresponding to the second plurality of measured values;

comparing the first average and the second average to at least a first threshold;

initializing the second operational mode when at least one of the first average or the second average exceeds the first threshold; and remaining in the first operational mode when none of the first average and the second average exceeds the first threshold.

6. The surface treatment apparatus of claim 5, wherein, when the surface treatment apparatus is in the second operational mode, if both of a third average and a fourth average are less than a second threshold the surface treatment apparatus transitions to the first operational mode.

7. The surface treatment apparatus of claim 1, wherein the first operational mode is a hard surface operational mode and the second operational mode is a carpet operational mode.

8. The vacuum cleaner of claim 3, wherein the first operational mode is a carpet operational mode and the second operational mode is a hard surface operational mode.

9. The surface treatment apparatus of claim 1 further comprising, in response to initializing the second operational mode, initializing a mode timeout, the mode timeout preventing initialization of the first operational mode for a predetermined time.

10. The surface treatment apparatus of claim 9, wherein the predetermined time is in a range of 0.5 seconds to 5 seconds.

11. The vacuum cleaner of claim 3 further comprising, in response to initializing the second operational mode, initializing a mode timeout, the mode timeout preventing initialization of the first operational mode for a predetermined time.

12. The vacuum cleaner of claim 11, wherein the predetermined time is in a range of 0.5 seconds to 5 seconds.

* * * * *